US008777595B2

(12) United States Patent
Arnold et al.

(10) Patent No.: US 8,777,595 B2
(45) Date of Patent: Jul. 15, 2014

(54) ROTARY PISTON ENGINE

(75) Inventors: Felix Arnold, Neckarsteinach (DE); Marian Kacmar, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 266 days.

(21) Appl. No.: 13/146,676

(22) PCT Filed: Jan. 20, 2010

(86) PCT No.: PCT/EP2010/050624
§ 371 (c)(1),
(2), (4) Date: Oct. 10, 2011

(87) PCT Pub. No.: WO2010/086267
PCT Pub. Date: Aug. 5, 2010

(65) Prior Publication Data

US 2012/0014826 A1 Jan. 19, 2012

(30) Foreign Application Priority Data

Jan. 28, 2009 (DE) ..... 10 2009 006 521

(51) Int. Cl.
*F01C 1/08* (2006.01)
*F01C 1/24* (2006.01)
*F04C 2/08* (2006.01)

(52) U.S. Cl.
CPC ..... *F04C 2/084* (2013.01)
USPC ..... 417/410.4; 418/195

(58) Field of Classification Search
CPC ..... F04C 2/082; F04C 2/084
USPC ..... 417/410.4; 310/156.22; 418/195
See application file for complete search history.

(56) References Cited

U.S. PATENT DOCUMENTS

| | | | | | |
|---|---|---|---|---|---|
| RE28,075 | E | * | 7/1974 | Kavanaugh | 310/49.17 |
| 3,856,440 | A | * | 12/1974 | Wildhaber | 418/195 |
| 4,384,828 | A | | 5/1983 | Rembold et al. | |
| 4,647,803 | A | * | 3/1987 | von der Heide et al. | 310/51 |
| 4,836,147 | A | | 6/1989 | Morris | |
| 5,513,969 | A | * | 5/1996 | Arnold | 418/195 |
| 6,499,966 | B1 | | 12/2002 | Werson et al. | |
| 7,049,718 | B2 | | 5/2006 | Nickel-Jetter et al. | |
| 7,390,181 | B2 | | 6/2008 | Arnold | |
| 8,360,748 | B2 | * | 1/2013 | Arnold | 417/360 |

FOREIGN PATENT DOCUMENTS

| | | | | |
|---|---|---|---|---|
| DE | 202006013319 | U1 | 2/2007 | |
| GB | 1308295 | A | 2/1973 | |
| WO | WO2007/128303 | * | 11/2013 | F04C 2/08 |

OTHER PUBLICATIONS

PCT/EP2010/050624 International Search Report.

* cited by examiner

*Primary Examiner* — Bryan Lettman
(74) *Attorney, Agent, or Firm* — Michael Best & Friedrich LLP

(57) ABSTRACT

A rotary piston engine comprises at least two rotors, a power component and a blocking component, which interact and have spur gearings, the number of teeth of which differs by one, the rotors and an engine housing accommodating the rotors delimiting working compartments. The rotors are twisted at a defined angle to each other. The power component is driven by and rotationally connected to an electric motor arranged on the same axis. The motor has an internal stator and an external rotor, the engine housing being directly connected to the motor. The engine housing has a supporting tube section projecting into and supporting the internal stator. The external rotor has a bell which encloses the internal stator and has a center drive shaft extending through the supporting tube section and rotationally connected to the power component, the drive shaft being mounted towards the inner wall of the supporting tube section.

17 Claims, 2 Drawing Sheets

ROTARY PISTON ENGINE

BACKGROUND OF THE INVENTION

The invention relates to a rotary piston engine according to the class of the main claim. In the case of one rotary piston machine, which is known from prior art and is of the kind which is class-specific to the patent publication WO2005/024237 A1 of the World Intellectual Property Organization, the applicant particularly emphasizes the advantageous fact that a relevant housing unit for the electric motor and the pump can be of small design. This is due to the electric motor directly engaging the power component of the rotors on the blocking component side without any additional costly bearing support. The housings can be embodied extremely simply and connected to one another. This is especially important for applications in fuel delivery systems of internal combustion engines, for example as a prefeed pump, wherein a very important quiet running of the engine is achieved with the rotary piston engine according to the invention. Said quiet running of the engine is particularly important for motor vehicle applications. In each case, the mounting and disposal of the power component with respect to the axis of rotation of the electric motor is extremely important and also that which relates to the relative axial displaceability of said power component. Such a housing unit can also be easily adapted to the requirements with regard to the gearing and the output thereby achieved.

SUMMARY OF THE INVENTION

The aim underlying the invention is to improve a rotary piston engine of the class-specific kind in such a way that said engine can be cost effectively produced, be used in a variety of ways and is improved in efficiency as well as in comparison to engines of prior art.

The rotary piston engine according to the invention is advantageous with respect to the machine of the prior art in that it can also be used for suction conveyance and has an extremely favorable speed ratio between the external rotor motor and the power component of the rotary piston engine so that a rotational speed of 4,000 rpm leads to a relative speed of 400 rpm of the rotors for a gear ratio of 9/10. In a comparable, most frequently used vane cell machine, the sealing lamellae are pressed with the outer sealing edge thereof with full peripheral speed radially onto the running surface, ie. corresponding to the centrifugal force acting radially on the lamellae. An additional advantage of the invention is most notably that due to the construction, particularly to the type of gearing of the machine rotors, only very small axial forces are required to ensure a small gap in the gearing, which is extremely sealing. As a result, the frictional power is firstly held very low, and secondly the wear is minimized at the sealing surfaces, which in any case leads to a good degree of efficiency.

According to one advantageous embodiment of the invention, the electric motor and the connections to the working compartments have opposite directions of rotation for a pressure or suction conveyance by the rotary piston engine. Such an embodiment, which increases the range of application of the machine, facilitates the manufacturing of the individual parts of the machine in large quantities for correspondingly versatile application requirements.

According to an additional advantageous embodiment of the invention, the rotor of the external rotor motor is covered towards the outside of the engine in a manner known per se (cf. German patent publication DE 103 58 759 A1) by a hood connected to the engine housing.

According to an additional advantageous embodiment of the invention, the engine housing comprises a flange-like center section having a mounting flange and apertures or noses for attaching the rotary piston engine to other objects, the central supporting tube section being disposed on one side of said center section and the housing accommodating the rotary pistons being attached to the other side of said center section. Means for attaching the engine housing are, of course, known per se; however, the rotary piston engine according to the invention offers here a novel flange attachment inasmuch as said engine has the flange on the center section of the engine housing, which significantly leads to a reduction in the total length of said rotary piston engine.

According to an advantageous design of the invention relating to this embodiment, the blocking component is disposed in this housing or in a plug of the double roller bearing provided, said plug being disposed on the end of said housing. The double roller bearing primarily takes on additional supporting functions and can also where applicable contribute to an axial adjustability of the blocking component.

Apart from the fact that the invention also provides for the drive shaft of the external rotor motor to be mounted on roller bearings in the supporting tube, cooling fins for cool air ventilation are disposed according to one embodiment of the invention on the side of the external rotor which faces away from the permanent magnet (cooling fins on the rotor, known per se from the German patent publication DE 20 2006 013 319 U1).

According to one advantageous embodiment of the invention relating to the gearing of the rotary piston engine, said gearing is specially provided for low pressures, i.e. a high ratio of engine rotational speed to the pump delivery rate.

BRIEF DESCRIPTION OF THE DRAWINGS

An exemplary embodiment of the subject matter of the invention is depicted in the drawings and explained in detail below.

The following are shown.

DETAILED DESCRIPTION

Figure 1:
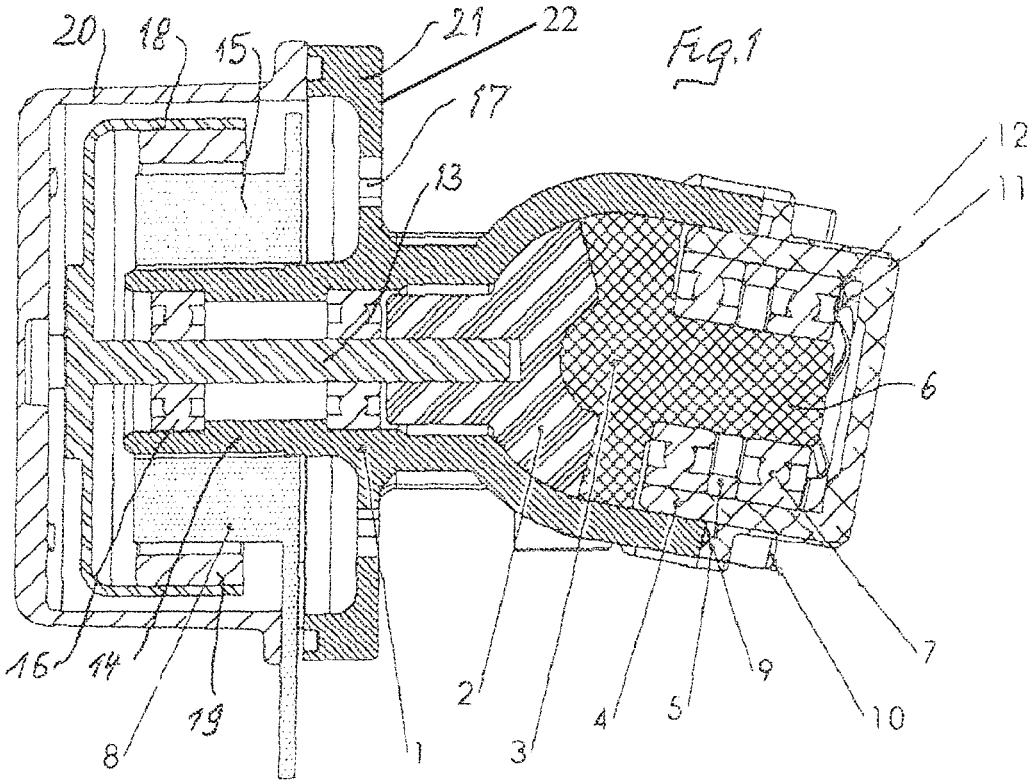
FIG. 1 a rotary piston engine by longitudinal cross-sectional view.

In the first exemplary embodiment depicted in FIG. 1, a power component 2 and a blocking component 3 are disposed in an engine housing 1, which engage in one another on the sides thereof which face one another via a trochoidal gearing. The engine housing 1 is closed on the blocking component side by a hollow cover 4, which is attached in the aperture accommodating the blocking component 3. A spacer ring 5 is disposed in the recess of the hollow cover 4 and separates two roller bearings 7 from one another, which are disposed on a journal 6 of said blocking component 3 and like the spacer ring 5 are supported outwardly in the radial direction on the interior wall of the hollow cover 4. Said roller bearings simultaneously take on the function of mounting said blocking component 3 in a manner which ensures a precise guiding of the same. Said hollow cover 4 is sealed towards the engine housing 1 by an o-ring 9 and is attached to said engine housing 1 by screws 10. The axial adjustability of said blocking component 3, which ensures a precise guidance and additionally a smooth operation of said blocking component 3, is achieved by an adjusting washer 11 and a wave spring 12 which engages the journal 6 on the end face thereof. In any case, such a rotary piston engine, in particular when used as a compressor, is known to run very quietly.

The power component 2 is driven by an external rotor motor, the drive shaft 13 of which is likewise mounted in the engine housing 1. For this purpose, said engine housing 1 has a supporting tube section 14 projecting into the stator 8 of the external rotor motor. The interior stator in the form of an electric coil 15 is disposed on the supporting tube section 14, the drive shaft 13 being mounted via roller bearings 16 on the interior side of said supporting tube section 14. There is a special rotating joint between the drive shaft 13 and the power component 2. Not least, said engine housing 1 is designed to be flange-like in a flange-like center section 22 between said supporting tube section 14 and the actual engine housing accommodating the power component and blocking component, said engine housing having mounting apertures 17 in order to affix the rotary piston engine in the simplest manner. Depending upon which type of embodiment is particularly practical, the mounting apertures 17 can, of course, be disposed in the free corners even if the flange has an angular construction.

A rotor bell 18 which encloses the internal stator 15 is affixed to the drive shaft 13, a magnet 19 which interacts with said internal stator 15 being disposed on the rotor bell 18. The external rotor motor is closed towards the outside by a hood 20, which is attached to the housing 1, in particular to the flange thereof.

Figure 2:
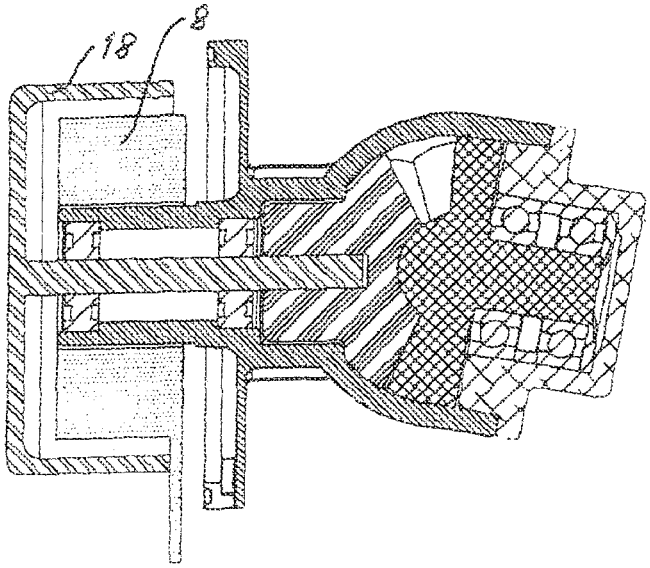
FIG. 2 a variant of this rotary piston engine from FIG. 1 likewise by longitudinal cross-sectional view and FIG. 3 an additional variant of the rotary piston engine according to the invention by longitudinal cross-sectional view.

The second exemplary embodiment depicted in FIG. 2 is basically configured like the first exemplary embodiment with small differences, the same reference numerals as in FIG. 1 being used for the same parts. The rotor bell 18 has in this case no auxiliary magnet but is embodied to be magnetic itself. In comparison to the first exemplary embodiment, the bell depth is therefore greater and the stator 8 is configured less wide. Besides that, this embodiment of the invention does not have a hood over the rotor bell in order to additionally save space and to mount the complete rotary piston engine including the motor in an aperture of a carrier via the flange 21 of the housing 1. In so doing, axial installation length is once again gained.

Figure 3:
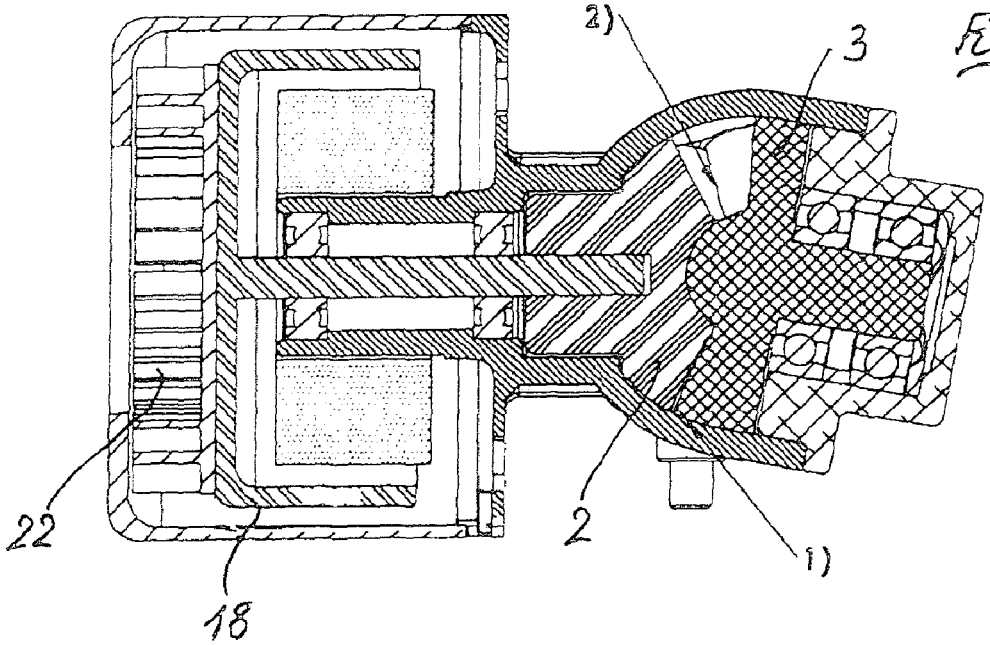

The third exemplary embodiment depicted in FIG. 3 comprises the aforementioned features of the first embodiment and partially those of the second embodiment, wherein co-rotating cooling fins 22 are added on the rotor bell 18 on the side facing away from the engine for the purpose of cooling said engine. In addition, sliding speeds are present in 1), which only have a fraction of the peripheral speeds of the rotors, between the power component 2 and the blocking component 3 due to the type of sealing gearing. At a rotational speed of 4,000 rpm, a rotor pair having a gear ratio of 9/10 thus has a maximum relative speed along the rotor periphery times 400 rpm. In the case of a vane cell compressor, the full peripheral speed would act on the radial outer sealing edge, i.e. at a maximum relative speed equal to rotor circumference times 4,000 rpm. In the case of 2), low loads exist at the sealing gaps between the rotors. The frictional power is thereby kept very low and wear to the sealing surfaces is minimized. The situation is different for the vane cell compressor, in which the mass of the lamellae is pressed against the running surface, which eccentrically surrounds the same, namely corresponding to the peripheral speed and the centrifugal force resulting therefrom.

REFERENCE NUMBER LIST

1 engine housing
2 power component
3 blocking component
4 hollow cover
5 spacer ring
6 journal
7 roller bearing
8 stator
9 o-ring
10 screws
11 adjusting washer
12 wave spring
13 drive shaft
14 supporting tube section
15 internal stator
16 roller bearing
17 mounting aperture
18 rotor bell
19 magnet
20 hood
21 flange
22 cooling fins

What is claimed is:

1. A rotary piston engine, comprising:

at least two rotors, a power component and a blocking component, which interact and which have spur gearings a number of teeth of which differs by one tooth, the rotors and an engine housing accommodating the rotors delimiting working compartments, wherein the rotors are twisted at a defined angle to each other to produce a lifting effect, wherein the power component is driven by an electric motor arranged on a common axis, the electric motor and said power component being rotationally connected and wherein the gearing is a trochoidal gearing, characterized, in that the electric motor is an external rotor motor having an internal stator and an external rotor, in that the engine housing is directly connected to said electric motor, in that said engine housing has a supporting tube section projecting into the internal stator and supporting the same, in that the external rotor has a rotor bell which encloses the internal stator and which has a center drive shaft extending through the supporting tube section and being rotationally connected to the power component, in that the drive shaft is mounted towards an inner wall of said supporting tube section, in that the engine housing comprises a flange-like center section having a mounting flange, and in that the mounting flange, the supporting tube section, and the engine housing are formed integrally as a single piece.

2. A rotary piston engine according to claim 1, characterized in that the supporting tube section is disposed on one side of said center section and a remainder of the housing accommodating the rotors is attached on an other side thereof.

3. A rotary piston engine according to claim 1, characterized in that the power component extends from the center section away from the supporting tube section.

4. A rotary piston engine according to claim 1, characterized in that the electric motor and the connections to the working compartments for a pressure conveyance have opposite directions of rotation for a suction conveyance.

5. A rotary piston engine according to claim 4, characterized in that the rotor of the external rotor motor is covered towards an outside of the engine by a hood connected to the engine housing.

6. A rotary piston engine according to claim 5, characterized in that the flange-like center section includes apertures or noses for attaching the rotary piston engine to other objects.

7. A rotary piston engine according to claim 6, characterized in that the blocking component is disposed in the housing or in a plug of a double roller bearing, said plug being disposed on the end of said housing.

8. A rotary piston engine according to claim 7, characterized in that the drive shaft of the external rotor motor is mounted in roller bearings in the supporting tube section.

9. A rotary piston engine according to claim 8, characterized in that cooling fins for cool air ventilation are disposed on a side of the external rotor which faces away from a permanent magnet.

10. A rotary piston engine according to claim 9, characterized in that the gearing includes a gear ratio of 9/10.

11. A rotary piston engine according to claim 1, characterized in that the rotor of the external rotor motor is covered towards an outside of the engine by a hood connected to the engine housing.

12. A rotary piston engine according to claim 1, characterized in that the flange-like center section includes apertures or noses for attaching the rotary piston engine to other objects.

13. A rotary piston engine according to claim 12, characterized in that the blocking component is disposed in the housing or in a plug of a double roller bearing, said plug being disposed on the end of said housing.

14. A rotary piston engine according to claim 1, characterized in that the drive shaft of the external rotor motor is mounted in roller bearings in the supporting tube section.

15. A rotary piston engine according to claim 1, characterized in that cooling fins for cool air ventilation are disposed on a side of the external rotor which faces away from a permanent magnet.

16. A rotary piston engine according to claim 1, characterized in that the gearing includes a gear ratio of 9/10.

17. A rotary piston engine according to claim 1, characterized in that the power component extends from the center section away from the supporting tube section.

* * * * *